US009109441B2

(12) United States Patent
Sun et al.

(10) Patent No.: US 9,109,441 B2
(45) Date of Patent: Aug. 18, 2015

(54) METHOD AND APPARATUS FOR CONTROLLING FLUID FLOW INTO A WELLBORE

(75) Inventors: Kai Sun, Missouri City, TX (US); Jesse J. Constantine, Jr., Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 697 days.

(21) Appl. No.: 12/981,897

(22) Filed: Dec. 30, 2010

(65) Prior Publication Data

US 2012/0168164 A1 Jul. 5, 2012

(51) Int. Cl.

| | |
|---|---|
| ***E21B 43/16*** | (2006.01) |
| ***E21B 34/14*** | (2006.01) |
| ***E21B 21/10*** | (2006.01) |
| *E21B 34/00* | (2006.01) |

(52) U.S. Cl.

CPC ..... *E21B 43/162* (2013.01); *E21B 21/103* (2013.01); *E21B 2034/007* (2013.01)

(58) Field of Classification Search

CPC ..... E21B 2034/007; E21B 33/146; E21B 21/103; E21B 43/162

USPC ..... 166/320, 321, 325, 373, 386, 332.1, 166/334.4; 137/494, 496, 538, 614.2

See application file for complete search history.

(56) References Cited

U.S. PATENT DOCUMENTS

| | | | | |
|---|---|---|---|---|
| 5,443,124 | A * | 8/1995 | Wood et al. | 166/374 |
| 7,510,013 | B2 * | 3/2009 | Kimpel | 166/373 |
| 7,640,990 | B2 | 1/2010 | Ross et al. | |
| 2006/0131033 | A1 | 6/2006 | Bode et al. | |
| 2009/0078427 | A1 | 3/2009 | Patel | |

OTHER PUBLICATIONS

International Search Report and Written Opinion dated Jun. 25, 2012 for International Application No. PCT/US2011/062232.

* cited by examiner

*Primary Examiner* — Jennifer H Gay
*Assistant Examiner* — George Gray
(74) *Attorney, Agent, or Firm* — Cantor Colburn LLP

(57) ABSTRACT

An injection apparatus for use in a wellbore is disclosed wherein the apparatus includes a tubular housing and a shield housing disposed outside the tubular housing, the shield housing including a chamber in fluid communication with the tubular housing. The apparatus further includes a piston disposed within the shield housing, the piston coupled to a biasing member, wherein movement of the piston controls fluid communication between the chamber and the wellbore, and wherein the movement of the piston is caused by a pressure change of a fluid within the tubular housing.

17 Claims, 4 Drawing Sheets

METHOD AND APPARATUS FOR CONTROLLING FLUID FLOW INTO A WELLBORE

BACKGROUND

To form a wellbore or borehole in a formation, a drilling assembly (also referred to as the "bottom hole assembly" or the "BHA") carrying a drill bit at its bottom end is conveyed downhole. The wellbore may be used to store fluids in the formation or obtain fluids, such as hydrocarbons, from one or more production zones in the formation. Several techniques may be employed to stimulate hydrocarbon production. For example, a plurality of wellbores (also "boreholes" or "wells"), such as a first and second wellbore, may be formed in a formation. The first wellbore is an injection wellbore and the second wellbore is a production wellbore. A flow of pressurized fluids from the first wellbore cause flow of formation fluids to the production wellbore. Specifically, the fluid is flowed downhole within a tubular disposed in the first or injection wellbore. One or more flow control apparatus, such as a valve, is located in the tubular to control the pressurized fluid flow into the formation. The pressurized fluid then causes an increased pressure within the formation resulting in flow of formation fluid into a producing string located in the second wellbore. A surface fluid source, such as a pump, provides the pressurized injection fluid to each flow control apparatus downhole.

If the fluid source shuts down or malfunctions, a pressure differential occurs between the formation zone receiving the injected fluid and the fluid inside the tubular. Specifically, a pressure caused by injecting fluid into a zone of the formation is significantly higher than the hydrostatic pressure within the tubular. The pressure differential can cause crossflow from the high pressure zone to other lower pressure zones in the formation. The flow from the high pressure zone can cause flow of sand and debris into the tubular and lower pressure zones, inhibiting flow paths and causing damage to the tubular string. Further, flow of sand and fluids from a first zone to a second zone eliminates isolation of zones, which is desirable during production. In addition flow of fluid from a high pressure zone can cause a high pressure wave or water hammer to propagate uphole in the tubular. The high pressure wave can damage equipment within the tubular string and at the surface.

One type of flow control device is controlled from the surface. A control signal to close fluid flow in the device may take several minutes or more to communicate from the surface. Due to the delayed control signal, the device remains open after a pump shut down, leading to communication of the pressure differential (between the formation and tubular) and resulting cross flow and pressure wave. In addition, in cases where the fluid source is shut down frequently, the flow control device is also closed frequently. The repeated opening and closing of the device increases the chance of failure, such as seal wear out. Another type of flow control device is controlled through intervention method (such as wire-line and coil tubing operations). In those examples, the delay to close flow devices is longer (e.g., 1-3 days), wherein the device remains open after a pump shut down, leading to communication of the pressure differential (between the formation and tubular) and resulting cross flow and pressure wave.

SUMMARY

In one aspect, an injection apparatus for use in a wellbore is disclosed wherein the apparatus includes a tubular housing and a shield housing disposed outside the tubular housing, the shield housing including a chamber in fluid communication with the tubular housing. The apparatus further includes a piston disposed within the shield housing, the piston coupled to a biasing member, wherein movement of the piston controls fluid communication between the chamber and the wellbore, and wherein the movement of the piston is caused by a pressure change of a fluid within the tubular housing.

In another aspect, a method for injecting fluid into a wellbore is disclosed wherein the method includes directing a fluid via a string to a tubular housing and directing the fluid through a first passage in the tubular housing into a chamber formed by a shield housing outside the tubular housing. The method further includes directing the fluid to the wellbore via a second passage in the chamber, wherein a pressure of the fluid moves a piston in the shield housing to an open position relative to the second passage and reducing the pressure of the fluid to move the piston to a closed position relative to the second passage, thereby restricting flow of the fluid to the wellbore.

BRIEF DESCRIPTION OF THE DRAWINGS

The disclosure herein is best understood with reference to the accompanying figures in which like numerals have generally been assigned to like elements and in which.

DETAILED DESCRIPTION

Figure 1:
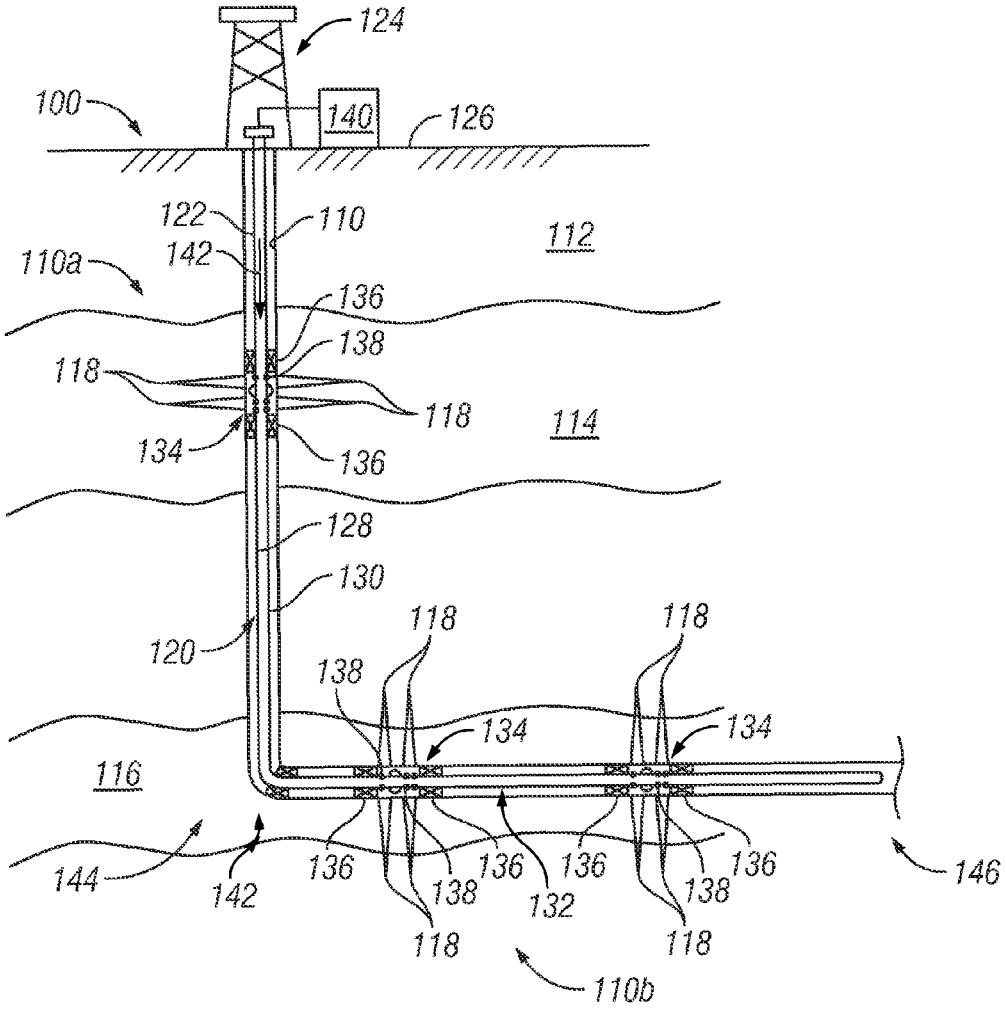
FIG. 1 is a schematic view of an embodiment of a system that includes a production tubular and injection apparatus.

Referring initially to FIG. 1, there is shown an exemplary wellbore system 100 that includes a wellbore 110 drilled through an earth formation 112 and into production zones or reservoirs 114 and 116. The wellbore 110 is shown lined with an optional casing having a number of perforations 118 that penetrate and extend into the formation production zones 114 and 116 so that formation fluids or production fluids may flow from the production zones 114 and 116 into the wellbore 110. The exemplary wellbore 110 is shown to include a vertical section 110*a* and a substantially horizontal section 110*b*. The wellbore 110 includes a string (or production tubular) 120 that includes a tubular (also referred to as the "tubular string" or "base pipe") 122 that extends downwardly from a wellhead 124 at surface 126 of the wellbore 110. The string 120 defines an internal axial bore 128 along its length. An annulus 130 is defined between the string 120 and the wellbore 110, which may be an open or cased wellbore depending on the application.

The string 120 is shown to include a generally horizontal portion 132 that extends along the deviated leg or section 110*b* of the wellbore 110. Injection assemblies 134 are positioned at selected locations along the string 120. Optionally, each injection assembly 134 may be isolated within the wellbore 110 by a pair of packer devices 136. Although only two injection assemblies 134 are shown along the horizontal portion 132, a large number of such injection assemblies 134 may be arranged along the horizontal portion 132. Another injection assembly 134 is disposed in vertical section 110*a* to affect production from production zone 114. In addition, a packer 142 may be positioned near a heel 144 of the wellbore 110, wherein element 146 refers to a toe of the wellbore. Packer 142 isolates the horizontal portion 132, thereby enabling pressure manipulation to control fluid flow in wellbore 110.

As depicted, each injection assembly 134 includes equipment configured to control fluid communication between a formation and a tubular, such as string 120. The exemplary injection assemblies 134 include one or more flow control apparatus or valves 138 to control flow of one or more injection fluids from the string 120 into the production zones 114, 116. A fluid source 140 is located at the surface 126, wherein the fluid source 140 provides pressurized fluid via string 120 to the injection assemblies 134. Accordingly, each injection assembly 134 may provide fluid to one or more formation zone (114, 116) to induce formation fluid to flow to a second production string (not shown). Injection fluids may include any suitable fluid used to cause a flow of formation fluid from formation zones (114, 116) to a production wellbore and string. Further, injection fluids may include a fluid used to reduce or eliminate an impediment to fluid production. As used herein, the term "fluid" or "fluids" includes liquids, gases, hydrocarbons, multi-phase fluids, mixtures of two of more fluids, water and fluids injected from the surface, such as water and/or acid. Additionally, references to water should be construed to also include water-based fluids; e.g., brine, sea water or salt water.

In an embodiment, injection fluid, shown by arrow 142, flows from the surface 126 within string 120 (also referred to as "tubular" or "injection tubular") to injection assemblies 134. Injection apparatus 138 (also referred to as "flow control devices" or "valves") are positioned throughout the string 120 to distribute the fluid based on formation conditions and desired production. In one exemplary embodiment, the injection apparatus 138 is configured to open to allow fluid to flow from tubular string 122 to wellbore 110 when a fluid pressure inside the tubular string 122 reaches a first level or value. In addition, the injection apparatus 138 is configured to close to shut off or restrict flow of the fluid from the tubular string 122 when the fluid pressure is lowered to a second level that is less than the first pressure level. The injection apparatus 138 moves to a closed position shortly after a stoppage of pumping by the fluid source 140 to prevent a pressure differential from being communicated via fluid between the tubular string 122 and wellbore 110. As discussed in detail below, exemplary injection apparatus 138 are controlled passively by a pressure level inside the tubular string 122, thereby improving performance of an injection process while reducing equipment and complexity of the tubular string 122.

Figure 2:
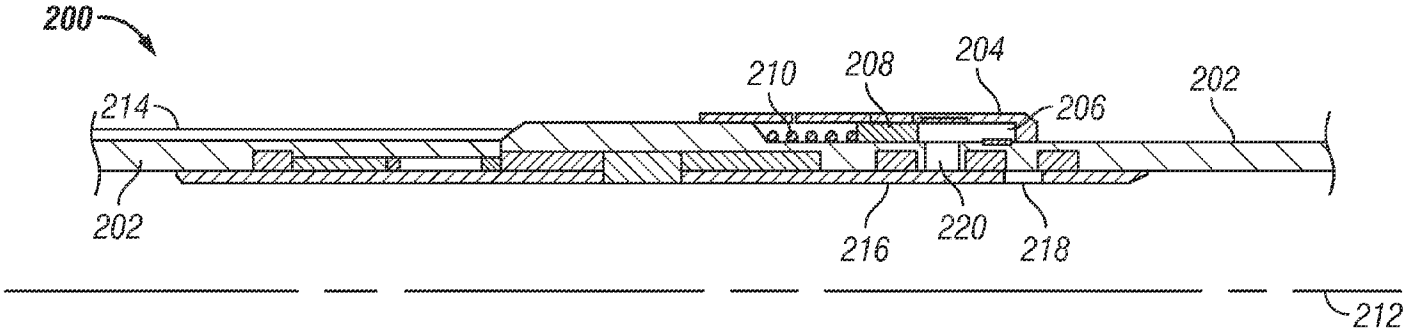
FIGS. 2 and 3 are sectional side views of an exemplary injection apparatus in a fully closed position.
Figure 3:
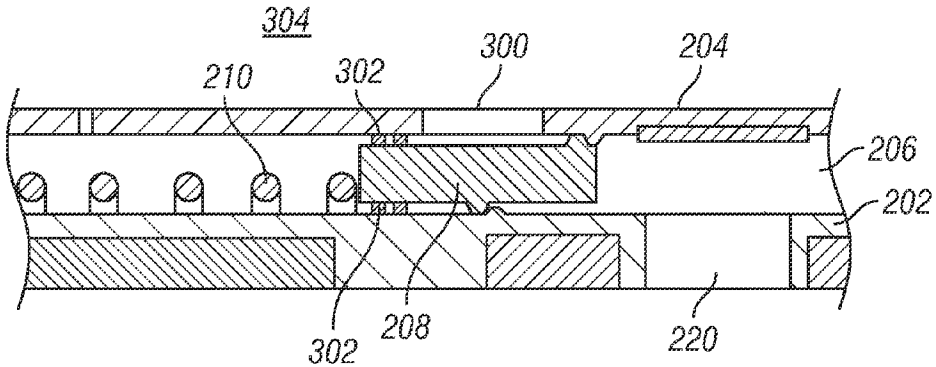

FIGS. 2 and 3 are sectional side views of an exemplary injection apparatus 200 in a fully closed position, wherein FIG. 3 shows more detail of selected portions of the apparatus. The injection apparatus 200 includes a tubular housing 202, a shield housing 204 (or "blast shield"), a chamber 206, a piston 208 and a biasing member 210. The injection apparatus 200 is a generally cylindrical or tubular structure disposed about an axis 212. Control lines 214 run to the surface 126 (FIG. 1) and are configured to control downhole devices via hydraulic, optical and/or electrical lines. As depicted, the control lines 214 are configured to control a position of and coupled to an insert sleeve 216 disposed inside of the tubular housing 202. The shield housing 204 is disposed outside of the tubular housing 202 and forms the chamber 206 therein. The piston 208 and biasing member 210 are both disposed inside the shield housing 204, wherein the biasing member 210 is coupled to piston 208. The tubular housing 202 is coupled to and in fluid communication with the tubular string 122 (FIG. 1). In embodiments, the tubular housing 202 and injection apparatus 200 are disposed between sections of the tubular string 122. The fully closed position occurs when the insert sleeve 216 is in a closed position, wherein control lines 214 may communicate commands from the surface 126 to open the insert sleeve 216.

The depicted fully closed position of the injection apparatus 200 comprises the insert sleeve 216 in a closed position relative to the tubular housing 202, wherein the insert sleeve 216 restricts or shuts off fluid communication through a passage 218 and a passage 220 into the chamber 206. As discussed below, the insert sleeve 216 moves axially to enable fluid communication between the tubular housing 202 and chamber 206 via aligned passages 218 and 220. In addition, the fully closed position of the injection apparatus 200 comprises the piston 208 restricting or shutting off fluid communication between the chamber 206 and a wellbore annulus 304 via a passage 300. Further, the biasing member 210 is expanded to cause the piston 208 to a closed or restricted position, wherein structures on the piston 208, the tubular housing 202 and/or shield housing 204 restrict further axial movement of the piston 208. Seals 302, such as O-rings, are disposed adjacent to piston 208 to prevent or reduce fluid communication or flow from the chamber 306 and past the piston 208. It should be noted that the terms "blocked," "restricted," "closed" and "shut off" with respect to fluid communication and positions may include partially, substantially and completely restricting fluid communication, depending on application needs.

Figure 4:
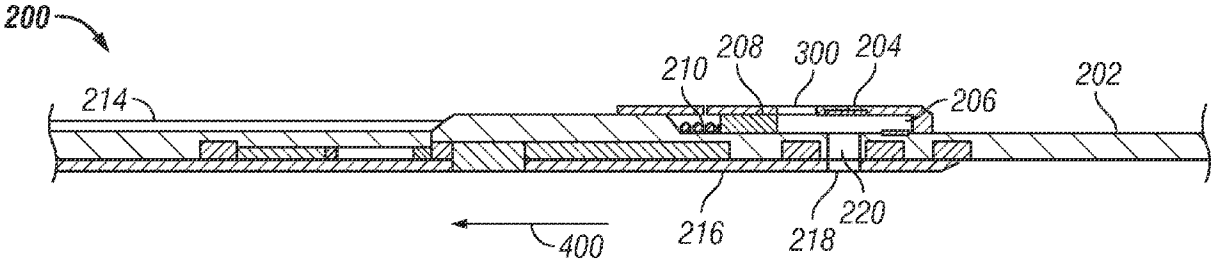
FIGS. 4 and 5 are sectional side views of an exemplary injection apparatus in an open position.
Figure 5:
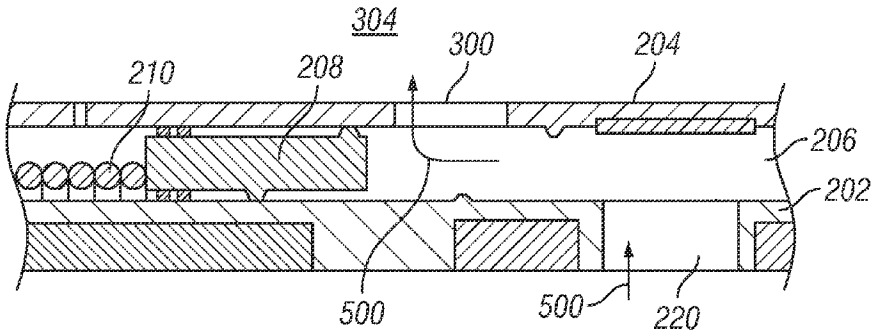

FIGS. 4 and 5 are sectional side views of the exemplary injection apparatus 200 in an open position, wherein FIG. 5 shows more detail of selected portions of the apparatus. As depicted, the insert sleeve 216 has been moved axially 400 with respect to FIGS. 2 and 3, wherein the passages 218 and 220 are aligned to provide fluid communication between the tubular housing 202 and the chamber 206. In addition, the piston 208 is moved axially 400 within the shield housing 204, thereby providing fluid communication between the chamber 206 and the wellbore annulus 304. In an embodiment, a pressure of fluid inside the tubular housing 202 is initially at a first level, wherein the first pressure level, within the tubular housing and chamber 206, does not move piston 208 to the open position. Then, the fluid pressure is increased to a second pressure level to overcome the force of the biasing member 210 and move the piston 208 to flow the pressurized fluid into the chamber 206. Exemplary injection fluids include liquids and/or gases, such as $CO_2$, water, saltwater and mud. The fluid is supplied from the fluid source 140 (FIG. 1) to the tubular housing 202 via string or tubular 122 (FIG. 1), wherein the fluid source 140 includes a pump configured to increase or decrease the fluid pressure as desired. Therefore, the increased pressure of the fluid causes a build up of pressure within the tubular housing 202 and chamber 206 to overcome the force of biasing member 210 to move the piston 208 to the open position. Thus, the open position of injection apparatus 200 enables fluid communication between the tubular housing 202, the chamber 206 and wellbore annulus 304, as shown by flow path 500.

Figure 6:
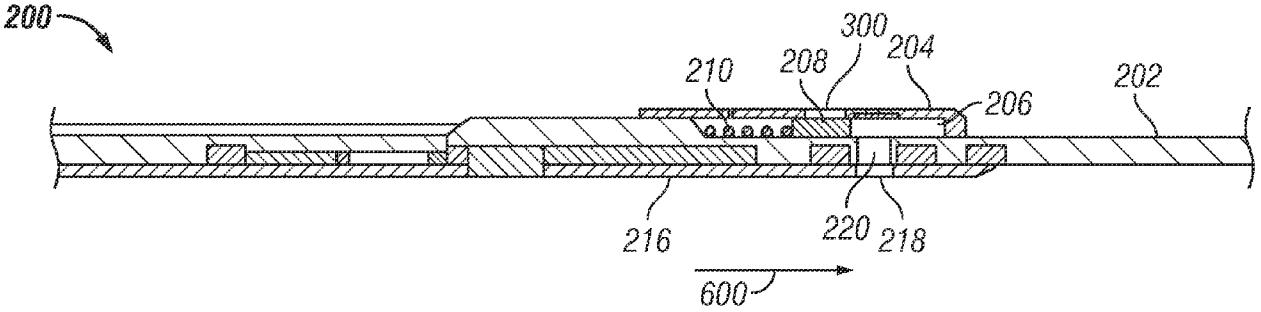
FIGS. 6 and 7 are sectional side views of an exemplary injection apparatus in a closed position.
Figure 7:
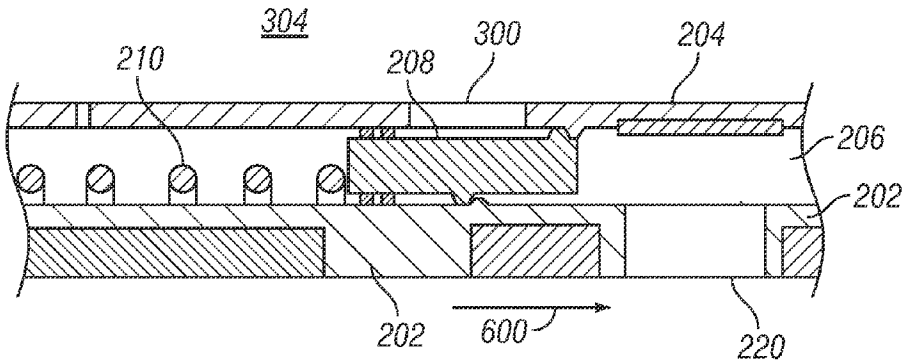

FIGS. 6 and 7 are sectional side views of the exemplary injection apparatus 200 in partially closed position, wherein FIG. 7 shows more detail of selected portions of the apparatus. The insert sleeve 216 remains in the open position, wherein the passages 218 and 220 are aligned to provide fluid communication between the tubular housing 202 and the chamber 206. The piston 208 is moved axially 600 within the chamber 206, shutting off fluid communication between the chamber 206 and the wellbore annulus 304. The biasing member 210 is expanded as the fluid pressure within the chamber 206 and the tubular housing 202 is reduced to a selected lower level, thereby causing the piston 208 to block or restrict fluid communication through the passage 300. Accordingly, the fluid pressure within the chamber 206 and the tubular housing 202 is reduced by the fluid source 140 (FIG. 1), wherein the force of the fluid pressure within the chamber 206 is less than the force of the biasing member 210, thereby enabling expansion of the biasing member 210 and restriction of flow through the passage 300. By restricting flow of fluid through passage 300 after a drop in pressure within the tubular housing 202 and chamber 206, a pressure differential between the wellbore annulus 304 and housing 202 is substantially closed off. Thus, the exemplary embodiment of injection apparatus 200 restricts fluid communication across the passage 300 to prevent damage that can be caused by fluid communication of the pressure imbalance between the tubular housing 202 and wellbore annulus 304.

In an exemplary embodiment, the injection apparatus 200 is run in at the fully closed position (FIGS. 2, 3), wherein the insert sleeve 216 is then moved to the open position by the control line 214. Then, a fluid pressure increase within the tubular string 122 and tubular housing 202 causes a pressure increase within the chamber 206, thereby moving the piston 208 to an open position (FIGS. 4, 5). The open position of the piston 208 and the insert sleeve 216 provides fluid communication for injection fluid flow from the tubular housing 202 to the wellbore annulus 304. When the pressure of the fluid inside the tubular housing 202 and chamber 206 is decreased to a selected level, the piston 208 is moved to a closed position, thereby restricting a flow path between the tubular housing 202 and wellbore annulus 304 (FIGS. 6, 7). Thus, when the fluid source 140 (FIG. 1) shuts off, the pressure reduction within the tubular housing 202 to a selected level causes the piston 208 to restrict fluid communication through passage 300, thereby preventing damage caused by a pressure differential between the wellbore annulus 304 and tubular housing 202.

As shown in FIGS. 1-7, the injection apparatus 200 provides an arrangement and method for controlling fluid flow from the tubular string 122 to the wellbore annulus 304, using a local and passive apparatus to prevent damage to wellbore equipment. Specifically, the position of the piston 208 controls fluid communication between the wellbore annulus 304 and the tubular housing 202, wherein the piston 208 position is controlled by a fluid pressure level within the tubular housing 202 and the chamber 206. For example, when the fluid source 140 pumping system fails, the pressure within the tubular string 122, tubular housing 202 and chamber 206 drops or is reduced, thereby causing the biasing member 210 to expand and restricting fluid communication between the wellbore annulus 304 and tubular housing 202. Accordingly, backflow of pressurized fluid from the formation is restricted from flowing into tubular housing 202, preventing communication of the resulting pressure differential across the passage 300

While the foregoing disclosure is directed to certain embodiments, various changes and modifications to such embodiments will be apparent to those skilled in the art. It is intended that all changes and modifications that are within the scope and spirit of the appended claims be embraced by the disclosure herein.

What is claimed is:

1. An injection apparatus for use in a wellbore, the apparatus comprising:

a tubular housing having at least one second passage through a wall thereof axially offset, longitudinally, from the at least one first passage;

a piston disposed between the shield housing and the tubular housing, the piston being biased by a biasing member; and a sleeve movably disposed within the tubular housing, a chamber being defined between the tubular housing, the shield housing the piston and the sleeve such that the chamber is initially fluidically isolated from an inside of the tubular housing and from the wellbore, movement of the sleeve allowing fluidic communication between the inside of the tubular housing and the chamber such that pressure at the inside of the tubular housing urges the piston against the bias of the biasing member and movement of the piston allows fluidic communication between the chamber and the wellbore.

2. The apparatus of claim 1, wherein the piston is axially movable to compress the biasing member.

3. The apparatus of claim 1, wherein the piston is configured to cover at least the second passage in the shield housing when the biasing member is expanded.

4. The apparatus of claim 1, wherein the biasing member is configured to expand when pressure inside the tubular housing is reduced, thereby moving the piston in a direction to restrict fluidic communication between the chamber and the wellbore.

5. The apparatus of claim 1, wherein a position of the piston within the chamber is configured to be controlled only by pressure changes at the inside of the tubular housing.

6. The apparatus of claim 1, wherein a position of the sleeve is controlled by a hydraulic mechanism.

7. The apparatus of claim 1, wherein the tubular housing is coupled to a string, the string comprising a source of fluid at a surface of the wellbore.

8. A method for injecting fluid into a wellbore, the method comprising:

directing a fluid via a string to an inside of a tubular housing;

moving a sleeve disposed within the tubular housing;

allowing fluid communication between the inside of the tubular housing and a chamber defined between the tubular housing, the sleeve, a shield housing and a piston via a first passage in the tubular housing;

building pressure against the piston via the fluid through the first passage;

moving the piston in a first direction;

directing the fluid to the wellbore via a second passage in the shield housing;

flowing the fluid axially, along a longitudinal axis, from the first passage to the second passage;

reducing pressure at the inside of the tubular housing;

moving the piston in a second direction; and closing the second passage, thereby restricting flow of the fluid to the wellbore.

9. The method of claim 8, further comprising reducing pressure at the inside of the tubular housing allowing a biasing member coupled to the piston to expand, causing axial movement of the piston toward a position that occludes fluidic communication between the chamber and the borehole.

10. The method of claim 8, further comprising exceeding a selected pressure against the piston and compressing a biasing member coupled to the piston to move the piston to allow fluidic communication between the chamber and the borehole.

11. The method of claim 8, further comprising controlling movement of the piston within the chamber by changing pressure at the inside of the tubular housing.

12. The method of claim 8, comprising moving the sleeve hydraulically.

13. The method of claim 8, further comprising providing the fluid from a source at a surface of the wellbore.

14. An injection flow control apparatus to be used downhole, the apparatus comprising: a shield housing positioned around a tubular housing defining an annular space I therebetween; and a piston disposed within the annular space being biased by a biasing member, and a position of the piston determines whether fluidic communication between the annular space and a wellbore is allowed, and movement of the piston is controlled by pressure supplied to the annular space from an inside of the tubular housing after a sleeve within the tubular housing has been moved to allow fluidic communication between the inside of the tubular housing and the annular space, fluidic communication between the inside of the tubular housing being through a first passage and fluidic communication between the annular space and the wellbore being through a second passage, the second passage being axially offset, longitudinally, from the first passage.

15. The apparatus of claim 14, wherein reducing pressure at the inside of the tubular housing below a first level allows the piston to move to a closed position, restricting fluidic communication between the inside of the tubular housing and the wellbore.

16. The apparatus of claim 15, wherein increasing pressure at the inside of the tubular housing to a second level causes compression of the biasing member, thereby allowing movement of the piston to a position that allows fluidic communication between the inside of the tubular housing and the borehole, wherein the second level of pressure is greater than the first level.

17. The apparatus of claim 15, wherein the piston being in a closed position prevents flow of wellbore fluid into the tubular housing caused by a pressure differential between the wellbore and the tubular housing.

* * * * *